US007715776B2

(12) United States Patent
Thayer et al.

(10) Patent No.: US 7,715,776 B2
(45) Date of Patent: May 11, 2010

(54) DUAL BLADE CLEANING SYSTEM

(75) Inventors: Bruce E. Thayer, Webster, NY (US); Richard W. Seyfried, Williamson, NY (US); Cheryl A. Linton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 302 days.

(21) Appl. No.: 12/021,500

(22) Filed: Jan. 29, 2008

(65) Prior Publication Data

US 2009/0190975 A1 Jul. 30, 2009

(51) Int. Cl.
*G03G 21/00* (2006.01)

(52) U.S. Cl. ..... 399/345; 399/350

(58) Field of Classification Search ..... 399/101, 399/27, 274, 283, 284, 345, 349, 350, 351; 15/236.05, 236.06, 256.5
See application file for complete search history.

(56) References Cited

U.S. PATENT DOCUMENTS

| | | | | | |
|---|---|---|---|---|---|
| 4,174,172 | A | * | 11/1979 | Lane | 399/348 |
| 4,314,756 | A | * | 2/1982 | Amitani et al. | 399/343 |
| 4,577,955 | A | * | 3/1986 | Mayer et al. | 399/345 |
| 4,969,015 | A | * | 11/1990 | Sanpe | 399/345 |
| 5,208,639 | A | | 5/1993 | Thayer et al. | |
| 5,241,351 | A | * | 8/1993 | Owens | 399/351 |
| 5,408,303 | A | * | 4/1995 | Fukunaga et al. | 399/123 |
| 5,610,699 | A | | 3/1997 | Yu et al. | |
| 5,778,296 | A | | 7/1998 | van der Steen et al. | |
| 6,438,329 | B1 | | 8/2002 | Budnik et al. | |
| 2003/0232262 | A1 | | 12/2003 | Yamada et al. | |
| 2007/0020005 | A1 | | 1/2007 | Shigezaki et al. | |
| 2009/0110416 | A1 | * | 4/2009 | Thayer et al. | 399/34 |
| 2009/0304406 | A1 | * | 12/2009 | Thayer et al. | 399/71 |
| 2009/0304407 | A1 | * | 12/2009 | Thayer et al. | 399/71 |

FOREIGN PATENT DOCUMENTS

| | | | | |
|---|---|---|---|---|
| JP | 57173870 | A | * | 10/1982 |
| JP | 63249872 | A | * | 10/1988 |
| JP | 05341699 | A | * | 12/1993 |
| JP | 10254254 | A | * | 9/1998 |
| JP | 2000250377 | A | * | 9/2000 |

* cited by examiner

*Primary Examiner*—Robert Beatty
(74) *Attorney, Agent, or Firm*—Fay Sharpe LLP

(57) ABSTRACT

A cleaning system for cleaning a moving surface of an image forming device, such as a photoreceptor. The cleaning system includes first and second links each having three pivot connections for pivotally connecting first and second cleaning blades together in mutually exclusive cooperative movement alternating between a common Cleaning Position at a first location and respective Suspended Positions. The cleaning system can include a Doctor Blade arrangement in which the cleaning blades are disposed in a Doctor Blade orientation in the Cleaning Position. The cleaning system can include a Wiper Blade arrangement in which the cleaning blades are disposed in a Wiper Blade orientation in the Cleaning Position. The first and second cleaning blades form similar Blade Holder Angles, Blade Deflection Angles and Working Angles when occupying the Cleaning Position.

20 Claims, 6 Drawing Sheets

DUAL BLADE CLEANING SYSTEM

BACKGROUND

Disclosed in embodiments herein are systems for cleaning an image forming device photoreceptor, and more specifically a dual blade cleaning system utilizing three-pivot links for moving the blades between separate Suspended Positions and a common Cleaning Position.

In electrophotographic applications such as xerography, a charge retentive photoreceptor belt or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contacting it with a finely divided electrostatically attractable toner. The toner is held in position on the photoreceptor image areas by the electrostatic charge on the surface. Thus, a toner image is produced in conformity with a light image of the original beam reproduced. Once each toner image is transferred to a substrate, and the image affixed thereto form a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the substrate sheet by fusing so as to create the single or multicolor copy or print.

Following the photoreceptor to substrate toner transfer process, it is necessary to at least periodically clean the charge retentive surface of the photoreceptor. In order to obtain the highest quality copy or print image, it is generally desirable to clean the photoreceptor each time toner is transferred to the substrate. In addition to removing excess or residual toner, other particles such as paper fibers, toner additives and other impurities (hereinafter collectively referred to as "residue") may remain on the charged surface of the photoreceptor.

The present application provides a new and improved apparatus for cleaning an image forming device moving surface, such as a photoreceptor surface, which overcomes at least the above-described problems.

DETAILED DESCRIPTION

Figure 1:
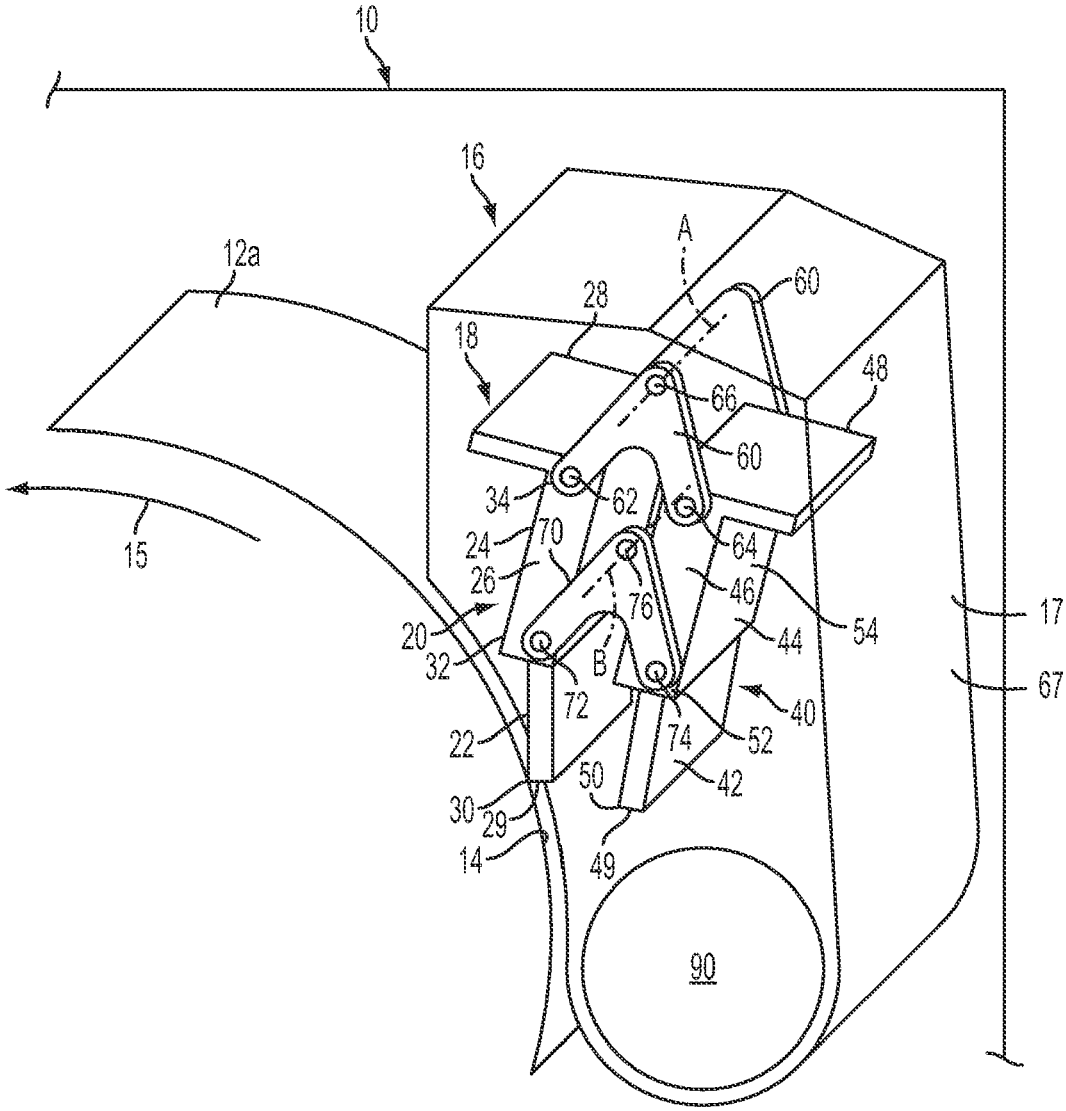
FIG. 1 is a perspective view illustrating the cleaning system having a Doctor Blade arrangement as described herein with a first cleaning blade disposed in the Cleaning Position.

With reference to FIG. 1, an image forming device is shown generally at 10. The image forming device 10 can be a copier, such as a xerographic copier, a printer, multifunction device or other device having a photoreceptor 12 for forming an image on a substrate such as for example paper (not shown). The photoreceptor 12 can be a drum photoreceptor 12*a*, a flat rigid photoreceptor 12*b* (shown in FIG. 3) or a belt photoreceptor 12*c* (shown in FIG. 4), or other photoreceptor, having a moving surface 14 which moves in an operational direction shown generally by arrow 15.

The image forming device 10 includes a cleaning system, shown generally at 16, for cleaning toner particles, residue and other materials from a moving surface 14, such as a photoreceptor surface 14. Though some examples provided describe a system for cleaning moving photoreceptor surfaces 14, the system 16 can also clean other image forming device moving surfaces, including but not limited to moving transfer surfaces such as biased transfer belts, biased transfer rolls, or intermediate transfer belts, examples of which can also be illustrated generally using the surfaces 14 depicted in FIGS. 3, 4, 7 and 8. Thus, the image forming device surfaces suitable for cleaning by the system 16 shall be referred to generally as moving surface 14.

The cleaning system 16 can be contained in a removable cartridge housing 17, if so desired, such as for example part of a print cartridge, also referred to a Xerographic Replaceable Unit (XRU). The XRU can be removed from the image forming device 10 and discarded when its useful life has been depleted.

The cleaning system 16 includes a first cleaning blade 20 having a cleaning blade member 22 extending from a blade holder 24 and terminating in an end 29. The cleaning system 16 also includes a second cleaning blade 40 having a cleaning blade member 42 extending from a blade holder 44 and terminating in an end 49. The cleaning blade members 22, 42 have upstream sides 22*a*, 42*a* and downstream sides 22*b*, 42*b* (shown in FIGS. 3 and 4) as referenced to the operational direction of surface travel 15. The cleaning blade members 22, 42 can be formed of a compliant material, such as polyurethane, which enable the blade members to bend or deflect when moved into cleaning contact with the moving surface 14 as described in further detail below.

Figure 3:
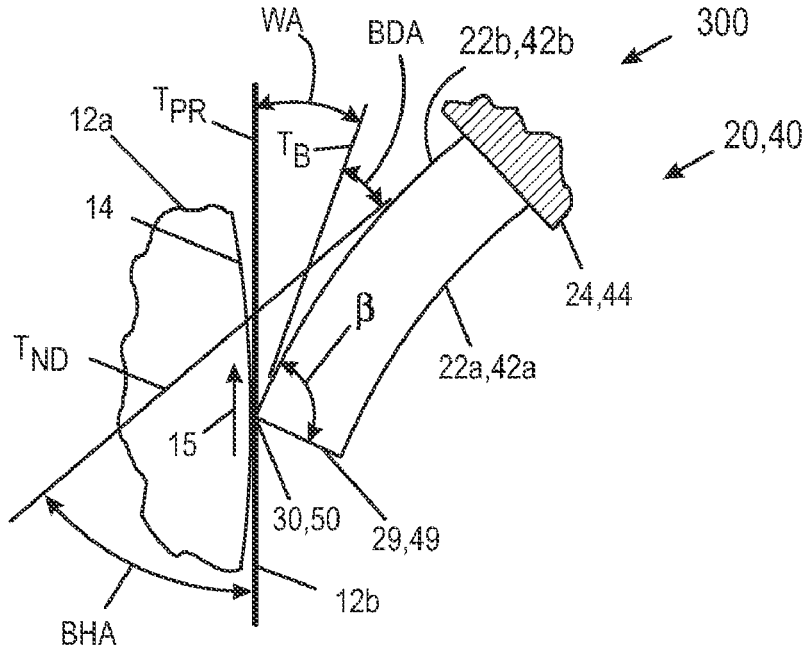
FIG. 3 illustrates the Doctor Blade orientation of the first and second blades disposed in the Cleaning Position.

Referring now to FIG. 3, the cleaning blades members 22, 42 include a cleaning tip, also referred to as a cleaning edge, 30 and 50 respectively, which is brought into cleaning contact with the moving surface 14 for cleaning same when the cleaning blades 20, 40 are moved into the Cleaning Position as shall be described in further detail below. The cleaning tips 30, 50 are formed between the blade member sides 22*b*, 42*b* and ends 29, 49 which meet at an angle β. For the purposes of the examples provided herein, β is 90 degrees, though it can be different. The cleaning tips 30, 50 can be coated with PMMA, SureLube, toner or other initial blade lubricant to prevent blade flip as the blades are moved into the Cleaning Position.

The blade holders 24, 44 can be formed of a rigid material such as aluminum, steel, other metals, composite plastics or other suitable rigid materials. They are elongated members having oppositely disposed lateral ends 26, 46 and 28, 48 respectively. The blade holders 24, 44 are disposed adjacent the moving surface 14, extending laterally across it at an approximate right angle to the operational direction 15. The blade holders 24, 44 have proximate portions 32, 52 and distal portions 34, 54, respectively, as referenced in relation to the adjacent photoreceptor 12.

The cleaning system 16 includes a pair of first links 60 formed of a rigid material, such as metal, plastic, composites or the like. The first links 60 are connected to opposite lateral ends of the cleaning blades 20 and 40 to couple the cleaning blade together for moving one blade member into the Cleaning Position while simultaneously moving the other blade into a corresponding Suspended Position, as shall be described in further detail below. The first links 60 are similar, unless stated below, and thus only one first link is shown in detail for the purposes of clarity. The first links 60 include first pivot connections 62 pivotally connected to the distal portions 34 of the oppositely disposed lateral ends 26 and 28 of the first blade holder 24. The first links 60 also include second pivot connections 64 pivotally connected to the distal portions 54 of the lateral ends 46 and 48 of the second blade holder 44. The first links 60 also include third pivot connections 66 pivotally connected to one or more frame members 67, enabling the first links to rotate about a fixed axis A while preventing non-pivoting displacement of the first links with respect to the frame. The frame 67 can be part of the cartridge 17, or a support member attached to the image forming device 10.

The cleaning system 16 also includes a pair of second links 70 formed of a rigid material, such as metal, plastic, composites or the like. The second links 70 are connected to opposite lateral ends of the cleaning blades 20 and 40 to also couple the cleaning blade members together as shall be described in further detail below. The second links 70 are similar, unless stated below, and thus only one second link is shown in detail for the purposes of clarity. The second links 70 include first pivot connections 72 pivotally connected to the proximate portions 32 of the oppositely disposed lateral ends 26 and 28 of the second blade holder 24. The second links 70 also include second pivot connection 74 pivotally connected to the proximate portions 52 of the lateral ends 46 and 48 of the second blade holder 44. The second links 70 also include third pivot connections 76 pivotally connected to one or more of the frame members 67', enabling the second links to rotate about a fixed axis B. The frame members 67' can be the same as those described above at 67, or different ones.

Figure 2:
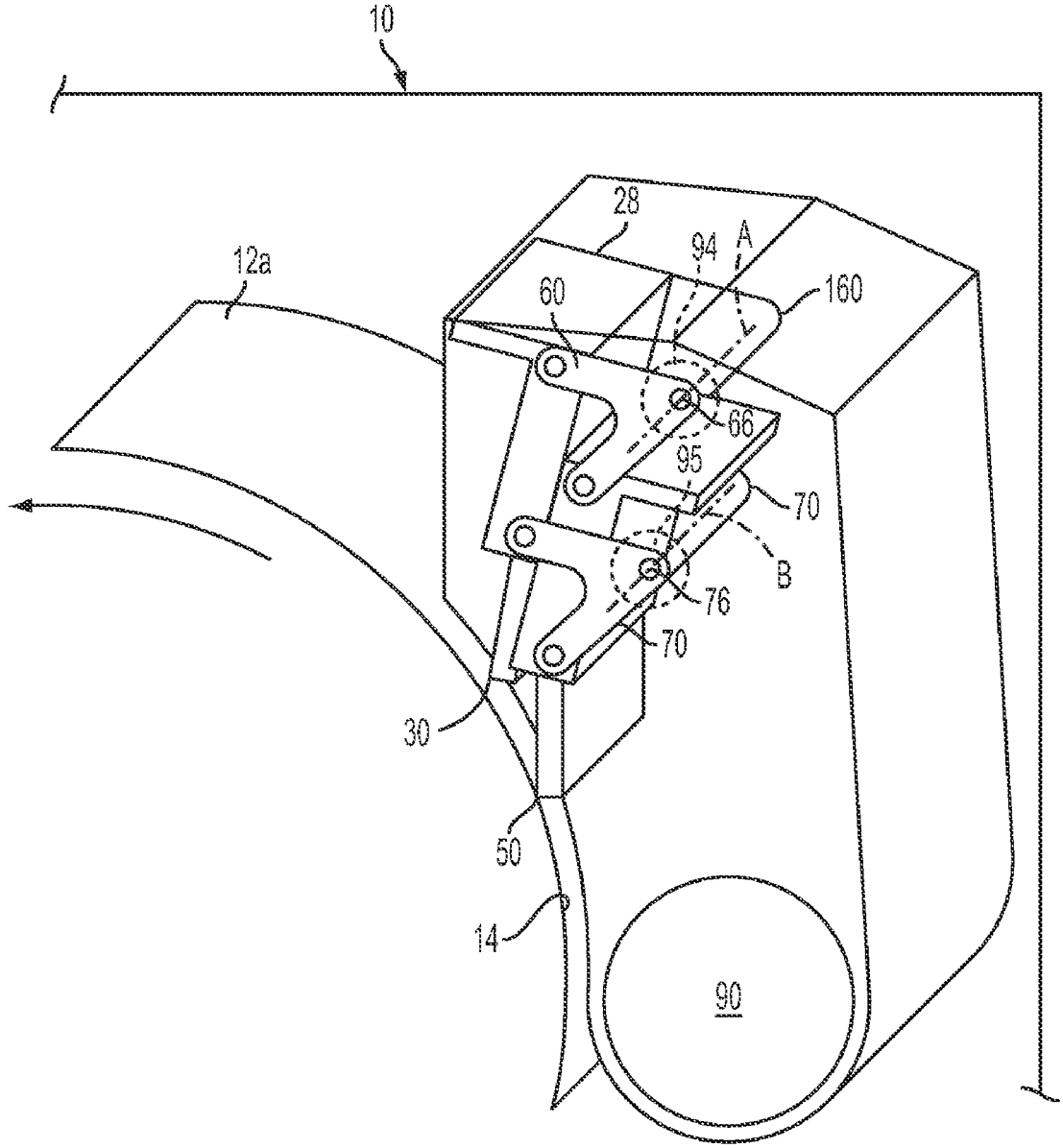
FIG. 2 is a perspective view illustrating the cleaning system having a Doctor Blade arrangement as described herein with a second cleaning blade disposed in the Cleaning Position.

The first and second link pivot connections 62, 64, 66, 72, 74, and 76 can be formed by fasteners, such as rivets, bolts or the like extending from the blade holders 24, 44 or frame 67, and through apertures in the first and second links 60, 70, or in other manners which enable relative rotation at the connections. The pivot connections 62, 64 and 66 are disposed in a triangular arrangement on the first links 60, and the pivot connections 72, 74 and 76 are disposed in a triangular arrangement on the second links 70. The first and second links 60, 70 can be V-shaped, each having 2 legs extending from the third pivot connections 66, 76 with the first pivot connections 62, 72 and second pivot connections 64, 74 disposed at the ends thereof, as shown in FIGS. 1 and 2. Such an arrangement can enable the links to be located close to each other without interfering in their movement. Other examples of the links 60, 70 can have triangular shapes with the pivot connections disposed at the vertices thereof. Other examples of the links can have other shapes.

An actuator 94, as shown in FIG. 2, can be connected to one of the first links 60 to rotate it about the third pivot connection 66. The actuator 94 can be a solenoid, or stepper motor, or some other actuator capable of rotating the first link 60 at connection 66. The actuator 94 can be disposed at the third pivot connection 66, or it can be disposed in another location and connected to the first link 60, such as by gears, arms, etc. so as to provide rotational movement to the first link 60. Other actuator arrangements capable of rotating the first and second links 60 and 70 about the third pivot connections, 66 and 76 respectively, are contemplated including, but not limited to using an actuator, shown at 95, connected to one of the second links 70 to rotate it about the third pivot connection 76, or two actuators 94 connected to each of the first links 60 or two actuators 95 connected to each of the second links 70 for rotating them about the third pivot connections 66 and 76 respectively. The first or second link driven by the actuator 94 or 95, for rotation can be referred to as the drive link, whereas the undriven link can be referred to as the follower link.

The operation of the cleaning system 16 shall now be described. For the purposes of simplicity, an example of the cleaning system 16 is provided using one actuator 94 connected to one of the first links 60, though it should be appreciated that operational movement of the cleaning blades 20, 40 as described herein can be extended to other arrangements of actuators as contemplated above.

At the end of the operational life of the first cleaning blade 20, the used blade is withdrawn from contact with the moving surface 14 and the second blade 40 is placed into operation in the Cleaning Position. The actuator 94 drives the first link 60 providing pivoting movement of the pair of first links 60 about the third pivot connections 66 at axis A. As the first links 60 are rotated about axis A, the second links 70 also rotate at the third pivot connections 77 about axis B. Upon actuation of the actuator 94, the cleaning blades 20 and 40 are alternately moved between separate Suspended Positions, disposed at different locations, and the common Cleaning Position, disposed at a single location, for cleaning the moving surface 14. Only one of the cleaning blades 20 and 40 will be disposed in the Cleaning Position at a time, during which time the other blade will be disposed in its respective Suspended Position with the blade member separated from the moving surface 14, as described in further detail below.

Figure 4:
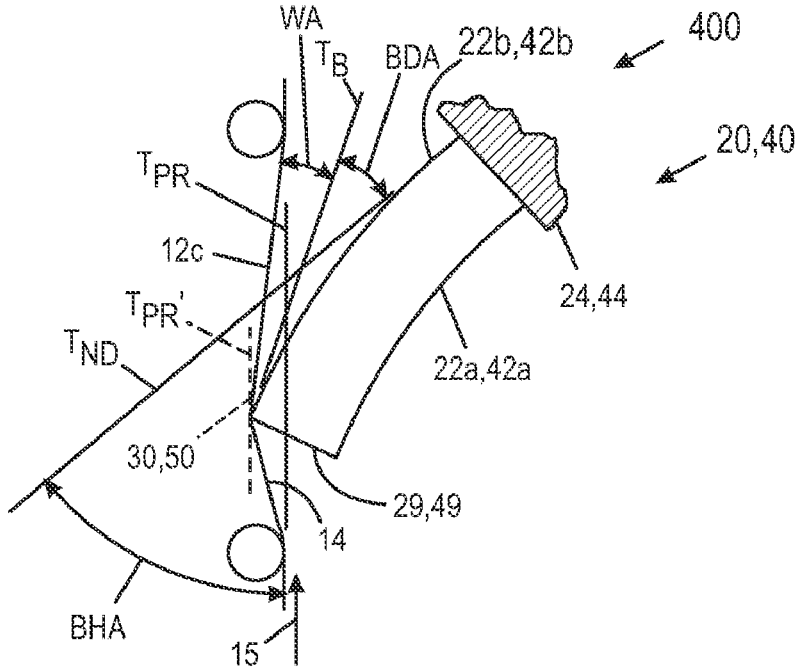
FIG. 4 illustrates the Doctor Blade orientation of the first and second blades disposed in the Cleaning Position.
Figure 5:
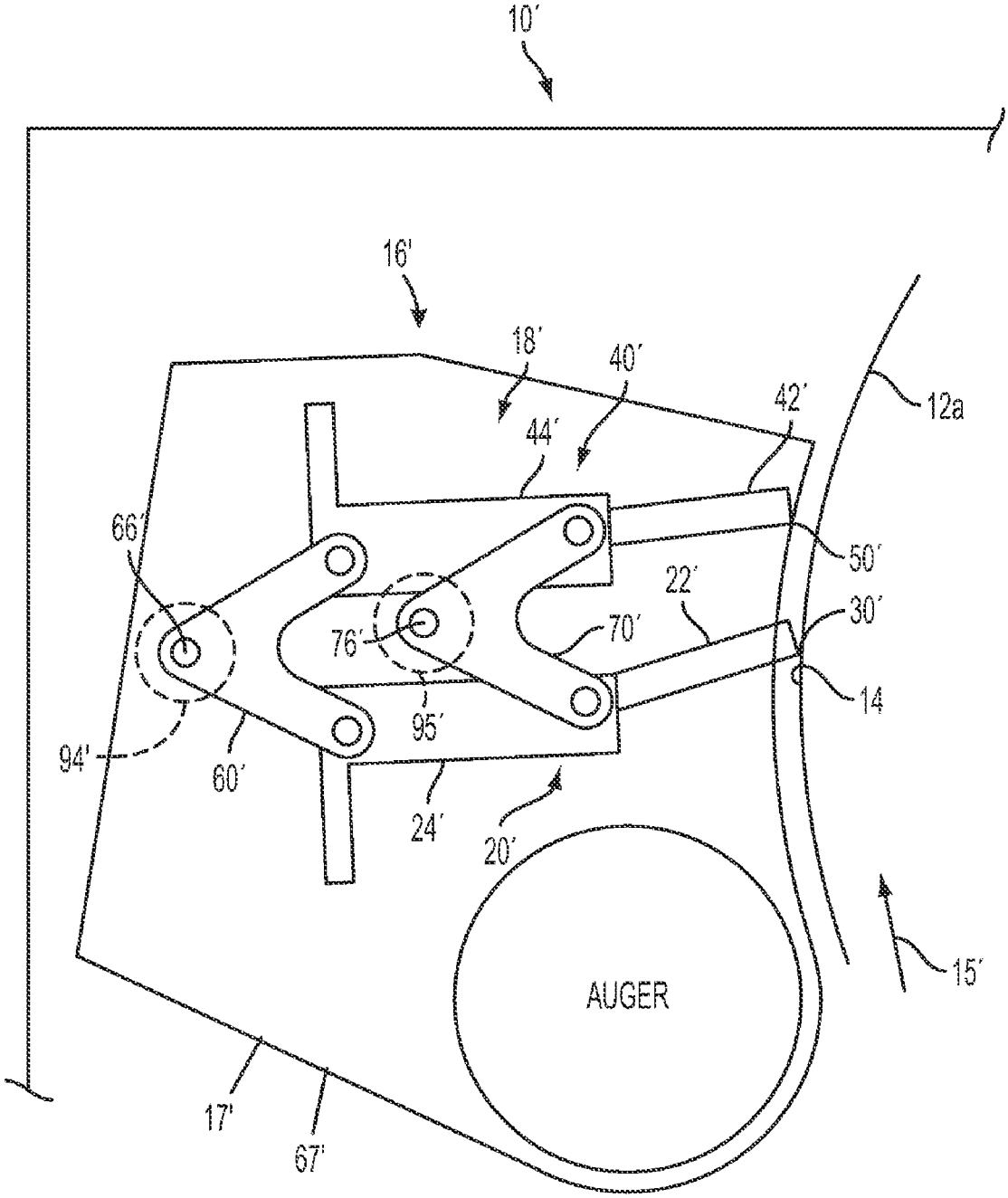
FIG. 5 is a perspective view illustrating the cleaning system having a Wiper Blade arrangement as described herein with a first cleaning blade disposed in the Cleaning Position.
Figure 6:
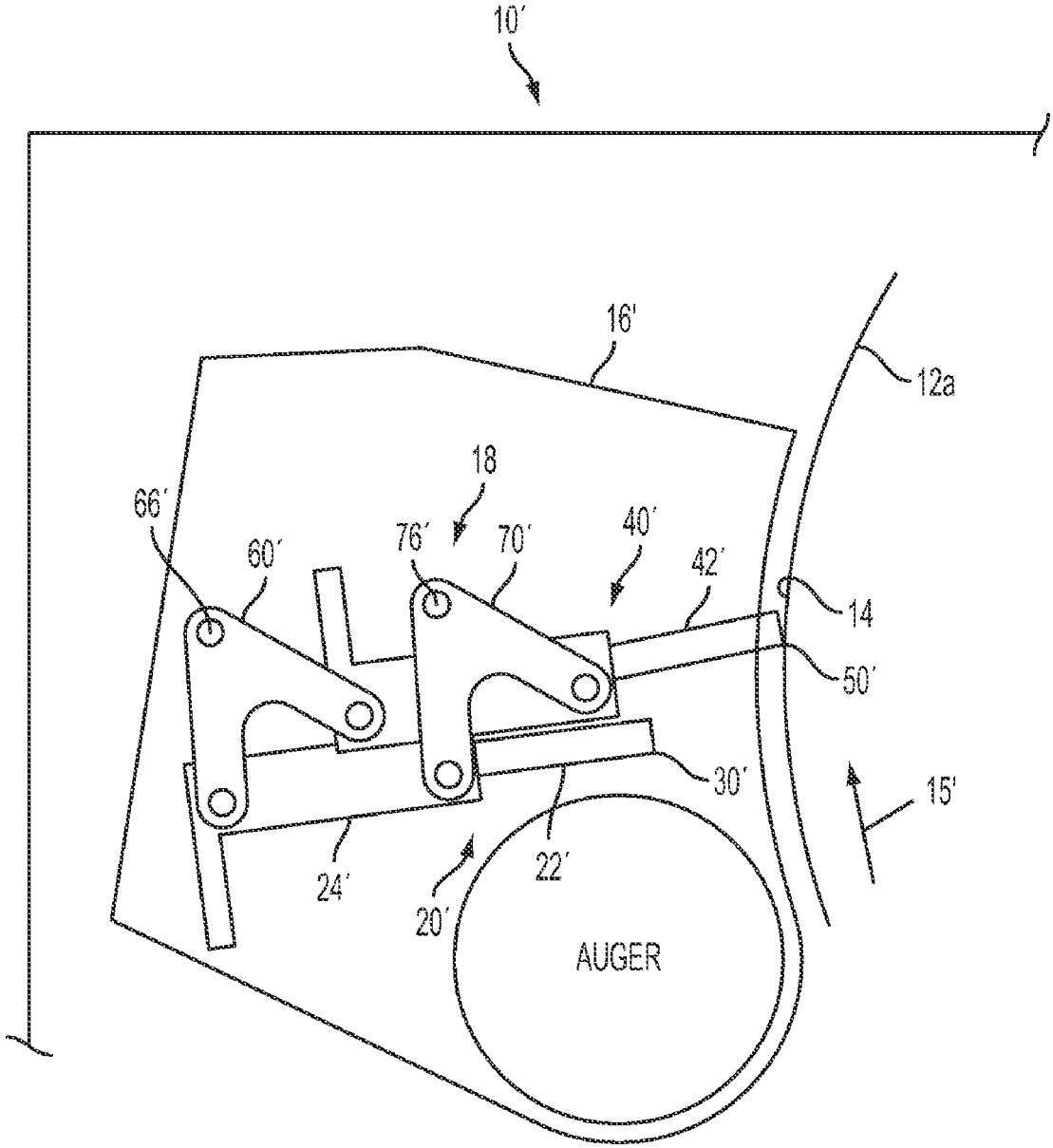
FIG. 6 is a perspective view illustrating the cleaning system having a Wiper Blade arrangement as described herein with a second cleaning blade disposed in the Cleaning Position.

The cleaning blade system 16 can be provided in a Doctor Blade embodiment, as shown in FIGS. 1 and 2, wherein the cleaning blades 20, 40 are in a Doctor Blade orientation when disposed in the Cleaning Position, referred to herein as $CP_{DB}$, as described in FIGS. 3 and 4. Alternatively, cleaning blade system 16' can be provided in a Wiper Blade arrangement, as shown in FIGS. 5 and 6, wherein the cleaning blades 20' and 40' are in a Wiper Blade orientation when disposed in the Cleaning Position, referred to herein as $CP_{WB}$, as described in FIGS. 7 and 8.

As shown in FIG. 1, the first cleaning blade 20 is in the Doctor Blade Cleaning Position $CP_{DB}$ such that the first blade member cleaning tip 30 is in cleaning contact with the moving surface 14 in a Doctor Blade orientation. The second cleaning blade 40 is in its respective Suspended Position such that the cleaning tip 50 is separated from the moving surface 14, as shown. The actuator 94 moves the drive link rotating it about the third pivot connection thereby rotating the drag link about its corresponding third connection also, to move the first cleaning blade 20 from the $CP_{DB}$ to its respective Suspended Position as shown in FIG. 2. Simultaneously, the second cleaning blade 40 is moved from its Suspended Position into the same $CP_{DB}$ at the same location previously occupied by the first blade 20' such that the second blade member cleaning tip 50 is in cleaning contact with the moving surface 14 in the Doctor Blade Orientation.

Referring now to FIG. 3 the Doctor Blade orientation for cleaning blades 20 and 40 disposed in $CP_{DB}$ for a curved moving surface 14, such as a drum photoreceptor 12*a*, and for a flat rigid moving surface 14, such as a flat photoreceptor 12*b*, is shown generally at 300. For the purposes of this description, a tangent $T_{PR}$ is taken at curved moving surface which can be considered as being similar to the flat moving surface, both which are referred to as the moving surface 14. In $CP_{DB}$, the blade holder 24, 44 is oriented so that the Blade Holder Angle (BHA)<90 degrees as defined from the downstream side of the cleaning tip 30, 50. BHA can be measured as the angle between $T_{ND}$ and $T_B$, where $T_{ND}$ extends along the undeflected downstream side of the blade member 22*b*, 42*b* (i.e., just as it extends from the rigid blade holder 24, 44) and $T_B$ is a tangent to the downstream side of the blade member taken at the cleaning tip 30 or 50 when in cleaning contact with the moving surface.

In $CP_{DB}$, the cleaning blade 20 or 40 has been moved against the moving surface 14 with a predetermined pressure applied to the blade holder 24 or 44 to keep the tip 30 or 50 in cleaning contact against the moving surface 14 as the photoreceptor 12*a* or 12*b* moves in its operational direction 15. The compliant blade member 22 or 42 is deflected by a predetermined Blade Deflection Angle (BDA), which can be measured between $T_B$ and $T_{ND}$. In $CP_{DB}$, the blade member 20, 40 forms a working angle WA measured at the downstream side of the cleaning tip 30, 50 between $T_B$ and $T_{PR}$. In the example provided, BDA=BHA−WA. The WA can range from about 4 degrees to about 12 degrees, with other suitable ranges including from about 8 degrees to about 12 degrees. The BDA range BDA is chosen to provide a desired blade load for the chosen blade material. The modulus of the blade material, the blade thickness, the amount of extension of the blade member 22, 42 from the blade holder 24, 44 and the friction against the moving surface 14 determine the blade deflection, as measured by the BDA, required to obtain the desired blade load. The BHA is chosen to obtain both the desired BDA and WA. The blade loads can range from about 15 g/cm to about 60 g/cm with other suitable ranges including from about 25 g/cm to about 35 g/cm. Referring now to FIG. 4 the Doctor Blade orientation for cleaning blades 20, 40 disposed in $CP_{DB}$ for a flexible moving surface 14, such as for example a flexible photoreceptor 12*c*, is shown generally at 400. BDA is measured in a similar manner as described above, as the angle between $T_B$ and $T_{ND}$. BHA is measured as the angle between $T_{ND}$ and $T_B$. WA is the angle between $T_B$ and $T_{PR}$.

The cleaning system 16 moves both cleaning blades 20 and 40 into the same $CP_{DB}$ at the same location in a mutually exclusive manner so only one blade occupies the location at a time, so as to form the same BHA, BDA and WA for both cleaning blades. This is applicable for the moving surfaces 14 described above.

Referring now to FIGS. 5 and 6, an example of the image forming device, shown generally at 10', having a cleaning system with a Wiper Blade arrangement is shown generally at 16'. The Wiper Blade cleaning system 16' is similar to the Doctor Blade cleaning system 16 described above, with similar components referenced by like reference numerals using a (') to indicate the Wiper Blade distinction. As such, the cleaning system 16' includes first 60' and second links 70' disposed at each opposite lateral end of the cleaning blades 20' and 40', and connected thereto at first 62', 72' and second 64', 74' pivot connections similar to those described above. One or more actuators 94', 95', similar to those described above, are connected to at least one of the first or second links for rotating them about the third pivot connections 66', 76' thereby moving the cleaning blades between a single common Cleaning Position $CP_{WB}$ and two separate, respective Suspended Positions.

In FIG. 5, the first cleaning blade 20' is in $CP_{WB}$ such that the first blade member cleaning tip 30' is in cleaning contact with the moving surface 14' in the Wiper Blade orientation. The second cleaning blade 40' is in its respective Suspended Position such that the cleaning tip 50' is separated from the moving surface 14' as shown. At the end of the useful operational life of the first cleaning blade 20', the actuator 94' moves the drive link 60' rotating it about the third pivot connection at an axis similar to axis A described above, thereby rotating the follower link about its corresponding third link at an axis similar to axis B described above, also, to move the first cleaning blade 20' from $CP_{WB}$ to its respective Suspended Position as shown in FIG. 6. The second cleaning blade 40' is simultaneously moved from its Suspended Position into the $CP_{WB}$ at the same location previously occupied by the first blade 20', such that the second blade member cleaning tip 50' is in cleaning contact with the moving surface 14' in the Wiper Blade orientation.

Figure 7:
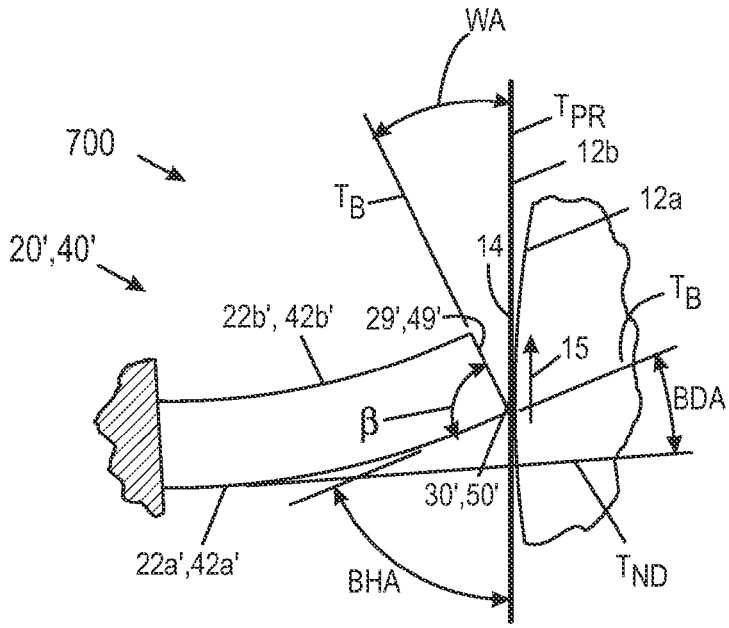
FIG. 7 illustrates the Wiper Blade orientation of the first and second blades disposed in the Cleaning Position.

Referring now to FIG. 7 the Wiper Blade orientation for cleaning blades 20' and 40' disposed in $CP_{WB}$ for a curved moving surface 14', such as a drum photoreceptor 12*a*', and a flat moving surface 14', such as a flat rigid photoreceptor 12*b*', is shown generally at 700. Tangents $T_{PR}$, $T_B$, and $T_{ND}$ are similar to those described above are used. In $CP_{WB}$, the blade holder 24', 44' is oriented so that BHA<90 degrees as defined from the upstream side of the cleaning tip 30', 50'. BHA can be measured as the angle between $T_{ND}$ and $T_{PR}$ as shown.

In $CP_{WB}$, the cleaning blade 20' or 40' has been moved against the moving surface 14' with a predetermined pressure applied to the blade holder 24' or 44' to keep the tip 30' or 50' in cleaning contact against the moving surface 14' as it moves in the operational direction 15'. The compliant blade member 22' or 42' is deflected by a predetermined BDA, which can be measured between $T_B$ and $T_{ND}$. In $CP_{WB}$, the blade member 20', 40' forms a working angle WA measured at the downstream side of the cleaning tip 30', 50' between a tangent to the end of the blade member $T_E$ and $T_{PR}$ as shown. In the example provided, BDA=BHA−WA. Similar ranges to those described above are suitable.

Figure 8:
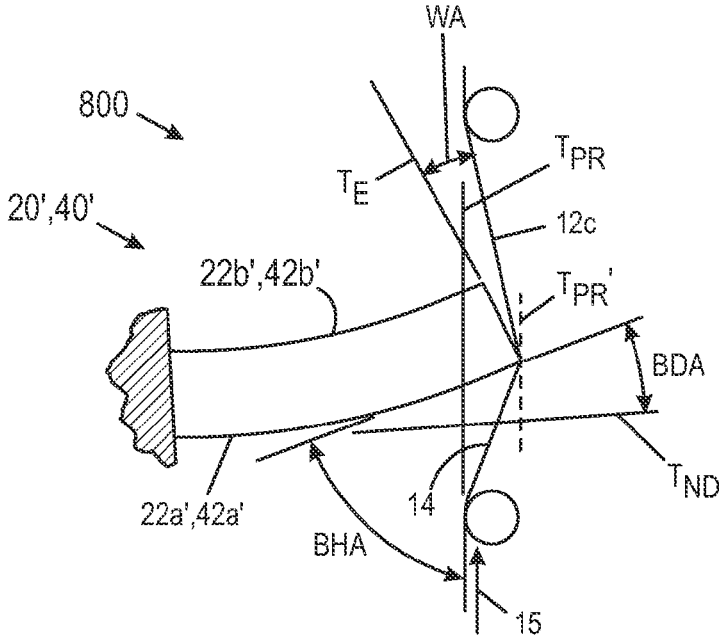
FIG. 8 illustrates the Wiper Blade orientation of the first and second blades disposed in the Cleaning Position.

Referring now to FIG. 8 the Wiper Blade orientation for cleaning blades 20', 40' disposed in $CP_{WB}$ for a flexible photoreceptor 12*c*' having a flexible moving surface 14' is shown generally at 800. BDA is measured in a similar manner as described above, as the angle between $T_B$ and $T_{ND}$. BHA is measured as the angle between $T_{ND}$ and $T_B$. WA is the angle between $T_E$ and $T_{PR}$.

The cleaning system 16' moves both cleaning blades 20' and 40' into the same $CP_{WB}$ at the same location in a mutually exclusive manner so only one blade occupies the location at a time, so as to form the same BHA, BDA and WA for both cleaning blades. This is applicable for the moving surfaces 14' described above.

The cleaning system 16 (16') uses first and second three-pivot links 60, 70 (60', 70') to couple the first and second cleaning blades 20, 40 (20', 40') together to provide accurate and repeatable positioning of both cleaning blades 20, 40 (20', 40') into a single Cleaning Position $CP_{DB}$ ($CP_{WB}$). The cleaning blade not occupying the Cleaning Position is moved into one of two respective Suspended Positions. The cleaning system 16 (16') provides a compact dual blade arrangement which can effectively double the useful life of the cleaning system as compared to single blade cleaners.

The cleaning system 16 (16') is configured to allow simplified replacement of blades 22, 42 (22', 42'). As the end of life of an operating cleaning blade is reached, the used blade 22 (22') or 42 (42') is withdrawn from contact with the moving surface 14 (14') and the second blade is placed into operation in the Cleaning Position. The life of the cleaning system 16 (16') between service intervals required for replacement of used blades is therefore extended with high reliability to more than twice the life of a conventional single blade system.

Blade changes can be initiated base on accumulated blade use, or blade failure identified by a failure sensor or the customer. Failure sensors can detect cleaning failures on the photoreceptor before they appear on prints, leading to blade replacements before customers are aware of faults.

If the cleaning system 16 (16') is contained within an XRU 17, the system can be easily replaced by replacing the XRU. The two blade cleaning system life would therefore be matched to the expected life of the other XRU components. For example, if a conventional XRU 17 having a single blade system has a cleaning blade life that is slightly longer than the life of the photoreceptor 12, then when a long life overcoat is applied to the photoreceptor to double its life, the blade life will become inadequate. A doubling of the expected useful life of the cleaning blade would typically more than triple the number of cleaning blade failures. Thus, the cleaning blade would then become the life limiter for the XRU. Changing from a conventional single blade to the two blade cleaning system 16 (16') will enable a long life XRU more suitable for use with the overcoated photoreceptor.

If the cleaning system 16 (16') is directly mounted into the machine bases 67, replacement can be independent of the other xerographic elements. When both blades 20, 40 (20', 40') have been used, the cleaning system can be replaced as a single unit. Alternatively, new cleaning blades 20, 40 (20' 40') can be mounted to the links 60, 70 (60', 70'). To avoid spreading dirt while changing cleaning blades, it is preferred to replace the cleaning system as a single unit. The single unit could, however, be reused by cleaning and replacing the blades in a remanufacturing process if so desired.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A cleaning system for cleaning a moving surface in image forming device, the cleaning system comprising:

a first cleaning blade having a blade member;

a second cleaning blade having a blade member;

a first link having a rigid body with three pivot connections including a first pivot connection pivotally connected to the first cleaning blade, a second pivot connection pivotally connected to the second cleaning blade, and a third pivot connection;

an actuator connected to the first link for pivoting the first link about the third pivot connection for moving the first cleaning blade between a Cleaning Position at a first location wherein the blade member is in a deflected working position in cleaning contact with a moving surface and a Suspended Position wherein the blade member is separated from the moving surface; and a second link having a rigid body with three pivot connections including a third pivot connection, a first pivot connection pivotally connected to the first cleaning blade for pivoting the second link about the third pivot connection as the first cleaning blade is moved, and a second pivot connection pivotally connected to the second blade assembly for moving the second cleaning blade between a Suspended Position wherein the blade member is separated from the moving surface and the Cleaning Position at the first location wherein the blade member is in a deflected working position in cleaning contact with the moving surface.

2. The cleaning system of claim 1 wherein the first link pivot connections are disposed in triangular arrangement and the second link pivot connections are disposed in triangular arrangement.

3. The cleaning system of claim 1 further comprising a base member pivotally connected to the first link at the third pivot connection for preventing non-pivoting displacement of the first link relative to the base member.

4. The cleaning system of claim 3 wherein the base member is a replaceable print cartridge or a replaceable cleaner cartridge connected to the image forming system to prevent non-pivoting displacement of the first link relative to the image forming system.

5. The cleaning system of claim 1 wherein the moving surface is a photoreceptor surface or a transfer surface.

6. The cleaning system of claim 1 further comprising:

the first cleaning blade having a first lateral end proximate portion disposed adjacent the moving surface and connected to the first pivot connection of the second link and a first lateral end distal portion disposed opposite the proximate portion connected to the first pivot connection of the first link; and the second cleaning blade having a first lateral end proximate portion disposed adjacent the moving surface connected to the second pivot connection of the second link and a distal portion disposed opposite the proximate portion connected to the second pivot connection of the first link.

7. The cleaning system of claim 6 further comprising a second pair of first and second links connected to second lateral ends of the first and second cleaning blades.

8. The cleaning system of claim 1 further comprising:

the first cleaning blade having a rigid blade holder and a compliant blade member extending from the blade holder, the blade member terminating in an end having a cleaning tip for contacting the moving surface for cleaning; and the second cleaning blade having a rigid blade holder and a compliant blade member extending from the blade holder, the blade member terminating in an end having a cleaning tip for contacting the moving surface for cleaning.

9. The cleaning system of claim 1 wherein the first and second cleaning blades are Doctor Blades disposed in a Doctor Blade orientation in the Cleaning Position.

10. The cleaning system of claim 9 wherein the first and second cleaning blades have similar Blade Holder Angles, Blade Deflection Angles and Working Angles when in the Cleaning Position.

11. The cleaning system of claim 1 wherein the first and second cleaning blades are Wiper Blades disposed in a Wiper Blade orientation in the Cleaning Position.

12. The cleaning system of claim 11 wherein the first and second cleaning blades define similar Blade Holder Angles, Blade Deflection Angles and Working Angles when disposed in the Cleaning Position.

13. An image forming device comprising:

a moving surface;

first cleaning blade having a cleaning tip for contacting the moving surface;

a second cleaning blade having a cleaning tip for contacting the moving surface;

first and second links pivotally connecting first lateral ends of the first and second cleaning blades together for mutually exclusive cooperative movement alternating between a common Cleaning Position at a first location wherein one of the cleaning tips is in cleaning contact with the moving surface and separate respective Suspended Positions separated from the moving surface.

14. The image forming device of claim 13 wherein the first link includes three pivot connections disposed in a triangular arrangement and the second link includes three pivot connections disposed in a triangular arrangement.

15. The image forming device of claim 13 wherein the first and second cleaning blades are Doctor Blades disposed in a Doctor Blade orientation in the Cleaning Position.

16. The image forming device of claim 13 wherein the first and second cleaning blades are Wiper Blades disposed in a Wiper Blade orientation in the Cleaning Position.

17. The image forming device of claim 13 further comprising:

a second pair of first and second links pivotally connecting second lateral ends, disposed opposite the first lateral ends, of the first and second cleaning blades together the cooperative movement.

18. The image forming device of claim 13 wherein the first and second links each include three pivot connections arranged in a triangle.

19. The cleaning system of claim 13 wherein the moving surface is a photoreceptor surface or a transfer surface.

20. A replaceable cartridge for an image forming device having a moving surface comprising:

a first cleaning blade having a blade member;

a second cleaning blade having a blade member;

a first link having a rigid body with three pivot connections including a first pivot connection pivotally connected to the first cleaning blade, a second pivot connection pivotally connected to the second cleaning blade, and a third pivot connection;

an actuator connected to the first link for pivoting the first link about the third pivot connection for moving the first cleaning blade between a Cleaning Position at a first location wherein the blade member is in a deflected working position in cleaning contact with a moving surface and a Suspended Position wherein the blade member is separated from the photoreceptor; and a second link having a rigid body with three pivot connections including a third pivot connection, a first pivot connection pivotally connected to the first cleaning blade for pivoting the second link about the third pivot connection as the first cleaning blade is moved, and a second pivot connection pivotally connected to the second blade assembly for moving the second cleaning blade between a Suspended Position wherein the blade member is separated from the moving surface and the Cleaning Position at the first location wherein the blade member is in a deflected working position in cleaning contact with the moving surface.

* * * * *